US005694955A

United States Patent [19]

Grooms

[11] Patent Number: 5,694,955

[45] Date of Patent: Dec. 9, 1997

[54] HAIR HOLDING DEVICE

[76] Inventor: Coleen Grooms, 11 Weyanoke Ct., Balto, Md. 21208

[21] Appl. No.: 601,175

[22] Filed: Feb. 14, 1996

[51] Int. Cl.[6] ..... A45D 2/18

[52] U.S. Cl. ..... 132/246; 132/247; 132/212; 132/273; 132/245

[58] Field of Search ..... 132/246, 245, 132/247, 253, 212, 273, 275

[56] References Cited

U.S. PATENT DOCUMENTS

| | | | |
|---|---|---|---|
| 2,525,981 | 10/1950 | Webster | 132/246 |
| 2,601,428 | 6/1952 | Bonneau | 132/246 |
| 2,693,809 | 11/1954 | Spencer | 132/247 |
| 3,418,194 | 12/1968 | Loftice | 132/273 |
| 4,310,008 | 1/1982 | Lalli | 132/247 |
| 5,372,152 | 12/1994 | Dutch | 132/247 |
| 5,404,892 | 4/1995 | Bretl | 132/212 |

FOREIGN PATENT DOCUMENTS

| | | | |
|---|---|---|---|
| 0597788 | 4/1978 | Switzerland | 132/246 |

*Primary Examiner*—Gene Mancene
*Assistant Examiner*—Pedro Philogene
*Attorney, Agent, or Firm*—John Lezdey

[57] ABSTRACT

A device is disclosed for curling and managing hair. The device has a soft deformable core with two ends and a rolling surface. The rolling surface is adapted so that the user's hair may be wrapped around it. The device also has two protruding members, one protruding member extending from each end of the core. Preferably, the protruding members are pliable such that they may be releasibly interlocked to pinch the hair to the core. An envelope covers the core and the protruding members. Finally, ornamental members are attached to the protruding members using an attachment mechanism.

17 Claims, 2 Drawing Sheets

HAIR HOLDING DEVICE

BACKGROUND OF THE INVENTION

The invention relates generally to hair accessories, and more specifically to a hair holding device that has ornamental features. Hair holding devices are well known in the art, and are used both for curling and for managing hair. Traditionally, devices used for curling were hard and often heated to enhance the curling process. The hair was tightly wrapped around these "curlers" or "rollers" and left in place. Over time, the hair would curl and assume the curve of the roller. Although such devices were effective, their heat and hardness made them uncomfortable. More recently, soft curlers have gained prominence. Soft curlers usually consist of a foam rubber core (or similar material), and flexible protrusions that extend from each end of the core and releasibly interlock. Although more time may be needed to form curls with soft curlers, when properly used, they also work effectively, and do so comfortably. Nevertheless, both hard and soft curlers suffer the same shortcoming—both are unsightly. The bulky and austere nature of the prior art curlers often renders the user an object of ridicule; even the situation of being caught with one's "hair in curlers" has become a cliché. Consequently, curlers are usually worn in private, which can be burdensome and unproductive. The inconvenience of wearing curlers naturally minimizes the time in which they are actually worn. Minimizing the curler's "set-time" however compromises their effectiveness, especially with soft curlers. Thus, the unsightly appearance of the curlers has the effect of reducing their effectiveness. A need therefore exists for a curler that comfortably curls the hair, yet is pleasing to the eye so that the user feels comfortable wearing curlers in public and over longer durations. The present invention fulfills this need. Indeed, the ascetically pleasing appearance of the device lends itself not only to a curler that can be worn in public, but also to a device for garnishing the hair.

SUMMARY OF THE PRESENT INVENTION

The present invention relates to a device for curling and managing hair. In one embodiment, the device has a soft deformable core having two ends and a rolling surface. The rolling surface is adapted so that the user's hair may be wrapped around it. The device also has two protruding members, one protruding member extending from each end of the core. Preferably, the protruding members are pliable such that they may be releasibly interlocked to pinch the hair to the core. An envelope covers the core and the protruding members. A bead slidable over each protruding member adjusts the size of the hair rolling area. Finally, ornamental members are attached to the protruding members using an attachment mechanism.

The following objects, features and advantages are met by one or more embodiments of the present invention:

It is an object of the invention to provide a comfortable curler having a soft core.

It is a further object of the invention to provide a curler having ornamental features that render it pleasing to the eye.

It is a feature of the invention that the user may select the desired ornamental objects for attachment to the device.

It is an advantage of the present invention that the soft core and ornamental features of the device render it comfortable not only to wear, but also to view.

These and other objects, features and advantages of the invention will be apparent to those skilled in the art upon consideration of the following description of the invention.

BRIEF DESCRIPTION OF THE DRAWINGS

The features of the present invention, which are believed to be novel, are set forth with particularity in the appended claims. The invention may best be understood by reference to the following description taken in conjunction with the accompanying drawings, wherein like reference numerals identify like elements, and wherein:

DETAILED DESCRIPTION OF THE PRESENT INVENTION

The present invention is directed at a hair accessory device for both curling and holding a user's hair. In its basic embodiment, the device comprises a soft deformable core having two ends and a rolling surface. The rolling surface is adapted so that the user's hair may be wrapped around it. The device also has two protruding members, one protruding member extending from each end of the core. Preferably, the protruding members are pliable such that they may be releasibly interlocked to secure the hair to the core after the hair has been wrapped around the core. An envelope covers the core and the protruding members. Finally, ornamental members are attached to the protruding members using attachment means.

The soft core and ornamental features of the device render it comfortable not only to wear, but also to view. Consequently, users will not face the embarrassment and anxiety of having their "hair in curlers." Absent this anxiety, it is anticipated that users will wear the device over longer durations thereby increasing the set-time of the curl, which is especially important with soft curlers. Since longer set-times equate to tighter curls, the ornamental features of the device with actually improve its effectiveness. Thus, a curler that is both comfortable and attractive has the synergistic effect of producing better curls with less burden.

Figure 1:
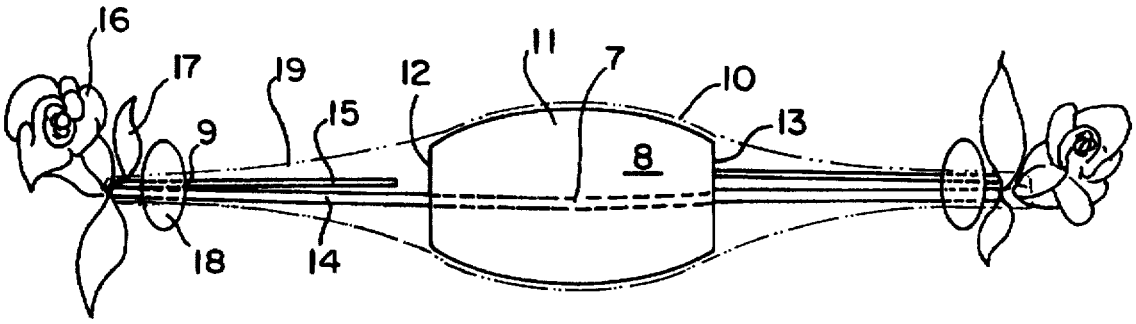
FIG. 1 shows one embodiment of the invention wherein the envelope is indicated with a phantom line to reveal the interior components of the invention.

Now referring to the figures, FIG. 1 shows a preferred embodiment of the device 10. The envelope 19 in this depiction ms sketched in phantom line for demonstrative purposes. Within the device 10, the core 11 is shown having two ends, 12, 13 and a rolling surface 8.

Figure 2:
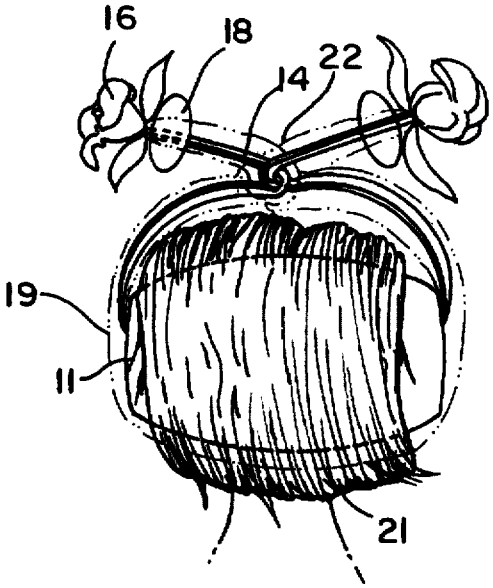
FIG. 2 shows the embodiment of FIG. 1 with the protruding members releasibly engaged.

As shown in FIG. 2, the user's hair 21 wraps around the core 11 for either curling or managing the hair. Preferably, the core 11 consists of a soft deformable material to provide an adequate surface to wrap hair thereon, and to conform to the user's head. Suitable materials include foam rubber, soft plastic, compacted tissue or other paper, and sponge. Additionally, since the hair wraps around the core 11 to produce the curl, the core 11 should be roughly the shape of the desired curl. In most situations, the desired curl is arc-like in shape, and consequently, the rolling surface 8 should have a substantially round cross-section. The preferred core 11 is therefore substantially cylindrical in shape as shown in FIGS. 1–4. It should be understood, however, that other shapes are possible without departing from the spirit of the invention, such as multi-faceted, rectilinear and barrel shaped cores. Moreover, it should be obvious that cores of varying diameter may be used depending upon the radius of the desired curl.

Protruding from the ends 12, 13 of the core 11 are the protruding members 14. In FIG. 1, only the left side is numbered, but one skilled in the art should realize that the device is essentially symmetrical and the same components can be found on both sides of the core 11. The protruding members 14 are long enough and pliable enough so that they may be bent over the core 11 and releasibly engaged to hold the hair 21 to the core 11 as shown in Fie. 2. Suitable materials for the members include wire, flexible plastic, and coated wires similar to pipe cleaners. Although two protruding members are required, it should be understood that they may be two ends of a single member. That is, the single member may long enough to pass through the core 11 such that its ends extend from the core and function as the protruding members. This embodiment is preferred since it reduces both the number of components used in the device and the need to connect the protruding member to the end of the core which may be difficult and unreliable. The embodiment of FIGS. 1–4 has a single member 7, and its portion that passes through the core 11 is shown as a dotted line.

FIG. 2 shows an embodiment in which the members are twisted together to form a knot 22. By interlocking the members, the hair 21 is held tightly against the core 11 for curling purposes or simply to manage the hair. Although the members are twisted to releasibly engage in this embodiment, other means of engaging are possible. For example, fasteners may be disposed upon either the protruding members themselves or the envelope covering them. The fasteners may then be used to releasibly engage the members. Suitable fasteners include snaps, buckles, and hook and loops. Of the suitable fasteners, a hook and loop fastener is preferred due to its flexibility and washability.

An ornamental member is attached to the protruding member with attachment means. In this particular embodiment, the ornamental member has an ornament 16, and a flexible, slender member 15 connected to the ornament 16. The ornament 16 may be any object, either real or a facsimile thereof, including flowers, leaves, fanciful bulbs, and even colorful fruit and birds. Indeed, the possibilities are limited only to the imagination of the user. The slender member 15 is disposed essentially parallel to the protruding member and attached to it with the attachment means. In FIGS. 1–4, a flower ornament 16 is shown accented with leaves 17 and a stem which also functions as the slender member 15.

The attachment means in this embodiment is a bead 18 having an orifice 9. Since the bead 18 is visible, it is preferable for the bead 18 to be aesthetically pleasing. Such beads are common and may be metallic, wood, or plastic. The orifice 9 is adapted to fit snugly around the protruding member 14 and the slender member 15 such that the slender member 15 is held secure relative to the protruding member 14. Although the primary purpose of the bead 18 is to hold the ornamental members to the protruding members, its also functions to seal and secure the envelope (see FIGS. 3–4). That is, in one embodiment, the envelope 19 is disposed over the core 11 and the protruding members 15, and the ends 31, 32 of the envelop 19 are twisted tight about the protruding members. The bead 18 is slipped over the twisted ends 31, 32 to keep them from unraveling. In yet another embodiment of the invention, the bead 18 is used to adjust the hair curling area. For example, the beads are slid toward the center of the core to reduce the size of the curl.

In the preferred embodiment, the attachment means is disengageable. The disengageable nature of the bead configuration of the attachment means enables ornamental members to be interchanged, which may be important to match styles and colors. For example, it may be desirous to adorn one's hair with white flowers for a wedding, or with glittery bulbs for a night on the town. It should be understood that other disengageable attachment means aside from the bead 18 are possible. Examples include a simple tie or a strip having releasible fasteners such as snaps, buckles and hook and loops. Alternatively, non-releasible adhesives and the like may be used if the user does not desire changing the ornamental members.

Figure 3:
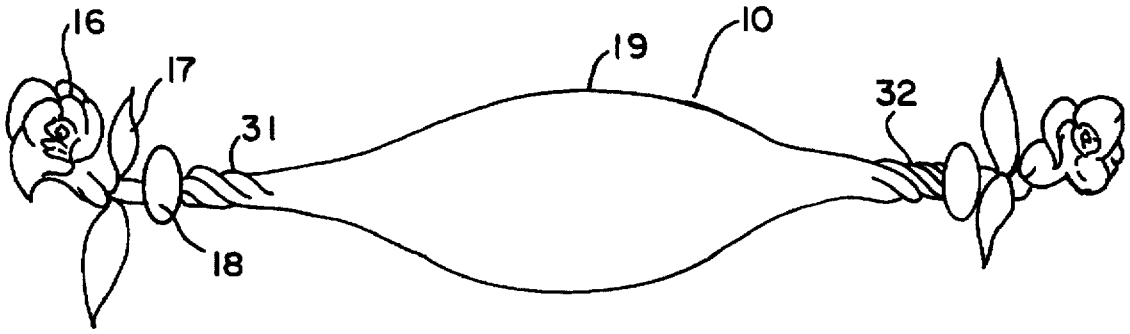
FIG. 3 shows the embodiment of FIG. 1 but with the envelope shown.
Figure 4:
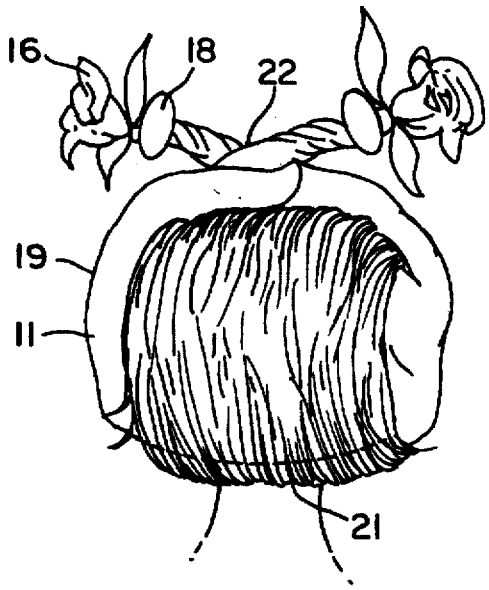
FIG. 4 shows the configuration of FIG. 2 but with the envelope shown.

The envelope 19 is shown covering the device in FIGS. 3–4. Since the envelope will contact the user's hair and scalp, it should be a soft, stretchable material. Additionally, the envelope should be absorbent to absorb residual moisture in the hair and perspiration. Suitable materials include linen, cheesecloth, gauze, lace, and fiber reenforced papers products. The configuration of the envelope may vary. That is, it could be a rectangular piece of material simply wrapped around the core and protruding members and twisted at the ends 31, 32 as shown in FIGS. 3–4. Alternatively, it may be a form fitted sleeve that is slid over one end. Other suitable configurations and methods of sealing the envelope will be obvious to one skilled in the art. The slender members 14 of the ornamental member may or may not be enveloped by the envelope depending upon the user's preference. Nevertheless, since the slender member will typically be non-ornamental and functional, it is preferred that it be covered by the envelope as shown in FIGS. 3–4.

Functionally, the user first assembles the device before use. To this end, the user selects the appropriate ornamental member such as a flower as shown in FIGS. 1–4. The envelope 19 is wrapped around the core 11 and protruding members 14. The envelope may be sealed using traditional sealing means or may be held closed with the attachment means. In the preferred embodiment, the envelope is twisted at the ends 31 and 32 causing it to constrict the protruding members 14. The bead 18 is slid over a portion of each twisted end to prevent the ends from unraveling. Next, the slender member 15 of each ornamental member is disposed though the orifice 9 and along each protruding member 14. Since the envelope is typically a porous material, the slender members may be slid through the envelope into place, or a small hole may be cut into the ends 31, 32 of the envelop to provide access. The orifice 9 of the bead 18 should be tight enough to prevent the slender members 14 from slipping out.

Once assembled, the user's hair 21 is ready to be wrapped around the core as shown in FIGS. 2 & 4. Wrapping the hair around the device is done in a traditional fashion. The hair may be wet or dry depending upon the user's preference and the degree of curl desired. After wrapping the hair, the protruding members 14 are folded up and over the core and releasibly engaged. In one embodiment, the members are twisted together to from a knot 22. The members therefore pinch the hair 21 against the core 11 to prevent it from unravelling. Additionally, the twisted configuration of the protruding member also serves to hold the ornamental members in place thus somewhat relieving the bead 18 of this task.

The device is then worn in place for ornamental purposes, or for the required set time of the curl. The longer the set time, the tighter the curl. Traditionally, users have had a strong desire to hasten the set time in an effort to relieve themselves of the unsightly and uncomfortable curler. Since the present device is attractive and comfortable, however, the user avoids this urge. Consequently, the increased set time results in fuller curls without the anxiety. The aesthetically pleasing nature of the device also makes it suitable as a hair ornament aside from a curler.

Obviously, numerous modifications and variations of the present invention are possible in the light of the above teachings. It is therefore understood that within the scope of the appended claims, the invention may be practiced otherwise than as specifically described herein.

What is claimed is:

1. A hair holding device comprising:

a soft deformable core having two ends and a rolling surface, said rolling surface being adapted to accommodate wrapping hair thereon;

two protruding members, one protruding member extending from each end of said core, said protruding members being sufficiently long and pliable to bend over said core and releasibly engage to pinch and hold a user's hair against said core;

an envelope for covering said core and said protruding members;

two ornamental members having means for attachment to said protruding members, one ornamental member corresponding to each protruding member; and at least one bead having a channel on each protruding member, said at least one bead being slidable along said protruding members for adjusting the area which holds the hair according to size of area and bulk of hair.

2. The device of claim 1, wherein each ornamental member comprises an ornament and a pliable, slender member connected to said ornament, said slender member being disposed substantially parallel to said protruding member, and wherein said attachment means urges said slender member against said protruding member.

3. The device of claim 2, wherein said protruding members are opposite ends of a single member, said single member passing through said core.

4. The device of claim 1, wherein said protruding members are opposite ends of a single member, said single member passing through said core.

5. The device of claim 1, wherein said ornamental member is a flower and said slender member is a wire.

6. The device of claim 2, wherein said slender member is disposed within said envelope.

7. The device of claim 1, wherein said core is substantially cylindrical.

8. The device of claim 1, wherein said core consists of foam rubber.

9. A hair holding device comprising:

a soft deformable core having two ends and a rolling surface, said rolling surface being adapted to accommodate wrapping hair thereon;

two protruding members, one protruding member extending from each end of said core, said protruding members being sufficiently long and pliable to bend over said core and releasibly engage to pinch and hold a user's hair against said core;

an envelope for covering said core and said protruding members;

two ornamental members, one ornamental member corresponding to each protruding member; and a bead member having an orifice, said bead member being slidably mounted on said protruding member through said orifice for adjusting the area which holds the hair according to size of area and bulk of hair, said orifice being adapted to fit snugly around said protruding member and a portion of said ornamental members such that said ornamental members are secured to said protruding members.

10. The device of claim 9, wherein each ornamental member comprises an ornament and a pliable, slender member connected to said ornament, said slender member being disposed substantially parallel to said protruding member, and wherein said attachment means urges said slender member against said protruding member.

11. The device of claim 9, wherein said protruding members are opposite ends of a single member, said single member passing through said core.

12. The device of claim 9, wherein said ornamental member is a flower, said slender member is a wire, and said connector is a bead.

13. The device of claim 12, wherein said protruding members are opposite ends of a single member, said single member passing through said core.

14. The device of claim 9, wherein said protruding members are opposite ends of a single member, said single member passing through said core.

15. The device of claim 9, wherein said slender member is disposed within said envelope.

16. The device of claim 9, wherein said core is substantially cylindrical.

17. The device of claim 9, wherein said core consists of foam rubber.

* * * * *